US006857862B2

(12) United States Patent
Johnson et al.

(10) Patent No.: US 6,857,862 B2
(45) Date of Patent: Feb. 22, 2005

(54) ROLLER VANE PUMP

(75) Inventors: Alan W. Johnson, Ames, IA (US); Richard L. Otto, Marshalltown, IA (US); Philip W. Katzer, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 10/427,213

(22) Filed: May 1, 2003

(65) Prior Publication Data

US 2004/0219046 A1 Nov. 4, 2004

(51) Int. Cl.[7] ..... F04C 15/04
(52) U.S. Cl. ..... 418/30; 418/225; 418/82
(58) Field of Search ..... 418/30, 225, 82

(56) References Cited

U.S. PATENT DOCUMENTS

| | | | | | |
|---|---|---|---|---|---|
| 1,728,321 | A | * | 9/1929 | Antonelli | 418/30 |
| 1,749,121 | A | | 3/1930 | Barlow | |
| 1,819,689 | A | * | 8/1931 | Ott | 418/30 |
| 2,460,018 | A | * | 1/1949 | Looke | 418/82 |
| 3,025,802 | A | | 3/1962 | Browne | |
| 3,072,067 | A | * | 1/1963 | Beller | 418/82 |
| 3,402,672 | A | * | 9/1968 | Cook | 418/225 |
| 3,402,891 | A | * | 9/1968 | Clark et al. | 418/31 |
| 3,415,058 | A | * | 12/1968 | Underwood et al. | 418/30 |
| 3,734,654 | A | | 5/1973 | Burenga et al. | |
| 4,342,545 | A | | 8/1982 | Schuster | |
| 4,531,893 | A | | 7/1985 | Okoh et al. | |
| 4,538,974 | A | | 9/1985 | Stich et al. | |
| 4,566,870 | A | * | 1/1986 | Kahrs | 418/30 |
| 4,578,948 | A | | 4/1986 | Hutson et al. | |
| 4,627,237 | A | | 12/1986 | Hutson | |
| 4,659,296 | A | | 4/1987 | Bristow | |
| 4,673,341 | A | * | 6/1987 | Bristow | 418/30 |
| 4,679,995 | A | | 7/1987 | Bristow | |
| 4,692,105 | A | | 9/1987 | Leroy | |
| 4,828,468 | A | | 5/1989 | Sipe et al. | |
| 6,152,711 | A | | 11/2000 | Van Wijk et al. | |
| 6,312,243 | B1 | | 11/2001 | Vab Wijk et al. | |
| 6,325,602 | B1 | * | 12/2001 | Rademacher | 418/81 |
| 6,375,445 | B1 | | 4/2002 | Van Wijk et al. | |
| 6,382,924 | B1 | | 5/2002 | Van Der Sluis et al. | |
| 6,398,528 | B1 | | 6/2002 | Hansen et al. | |
| 6,413,066 | B1 | | 7/2002 | Van Der Sluis et al. | |
| 6,416,303 | B1 | | 7/2002 | Van Der Sluis et al. | |
| 6,447,277 | B1 | | 9/2002 | Van Der Sluis et al. | |
| 6,464,482 | B1 | | 10/2002 | Van Der Sluis et al. | |
| 2002/0119060 | A1 | * | 8/2002 | Gentile et al. | 418/30 |

FOREIGN PATENT DOCUMENTS

| | | | | | |
|---|---|---|---|---|---|
| JP | 04269387 | A | * | 9/1992 | F04C/2/344 |

* cited by examiner

*Primary Examiner*—Theresa Trieu

(57) ABSTRACT

A fixed displacement pump includes a housing having a cavity, an inlet, and an end cap with alignment portions therein. A cam ring pivotally associated within the cavity includes adjustment portions. The cam ring is aligned in a fixed position via a pin inserted through both a select adjustment portion and a corresponding alignment portion. The adjustment portion selected determines both rotational direction and displacement of the pump. The cam ring also includes recesses positioned adjacent the inlet to facilitate porting of fluid through the pump. A rotor mounted within the cam ring includes roller slots having groove segments. The groove segments are positioned in an arcuate arrangement about the rotor to facilitate porting of fluid through the pump. The rotor also includes undercut portions positioned between the roller slots in an arcuate arrangement on an outer edge of the rotor to facilitate porting of fluid through the pump.

17 Claims, 4 Drawing Sheets

ROLLER VANE PUMP

BACKGROUND OF THE INVENTION

Pumps for replenishing the leakage flow from hydrostatic units are typically fixed displacement gerotor pumping units. These designs provide for different displacements by changing the axial thickness of the pumping unit. This requires that the pocket depth in the hydrostatic unit vary in depth to accommodate the change in displacement. Some designs achieve this same result by an intermediate piece that can accommodate this length change.

The added need for these pumps to work in either clockwise or counterclockwise rotation requires either that this intermediate member be designed to reverse the eccentricity or the eccentricity must be machined into the hydrostatic unit. The result of this is that multiple pieces are required to accommodate the change in displacement and change in rotation.

These added pieces increase the cost and complexity of the hydrostatic unit. This complexity can result in higher defect rates or higher inspection costs to insure that the correct parts or orientations have been chosen.

Fixed displacement roller vane hydrostatic units are an alternative to the gerotor pumping units. However, providing fixed displacement roller vane hydrostatic units for both clockwise and counterclockwise rotation typically requires designing a unique pump for each rotation desired. Likewise, providing fixed displacement roller vane hydrostatic units with a desired displacement requires designing a unique pump for each displacement desired.

The roller vane units have a further problem of providing sufficient inlet and outlet area at the rotor for porting fluid. Roller vane units normally provide for porting of fluid through valve plates into the area between the rollers, in a direction axial to the rotation of the rotor. Typical rotor designs are made with uniform outer edges between the rollers. These uniform outer edges can effectively limit the area available to port fluid into or out of the pump. Additionally, typical rotor designs are made with slots only large enough for receiving the rollers. This restriction on the size of the slots also can effectively limit the area available to port fluid into or out of the pump.

Variable displacement hydrostatic units are not a good solution for the deficiencies of current fixed displacement gerotor and roller vane hydrostatic units. Variable displacement hydrostatic units require additional elements for the external manipulation of the hydrostatic unit to manipulate the rotational direction or displacement of the hydrostatic unit. These additional elements are unnecessary for fixed displacement applications since these applications inherently do not require the variation of rotational direction or displacement levels once the unit is installed. Further, these additional elements increase the cost and complexity of variable displacement hydrostatic units as compared to fixed displacement hydrostatic units.

Therefore, a principal object of this invention is to provide a fixed displacement pump capable of being assembled to operate in either rotational direction.

A further object of the invention is to provide a fixed displacement pump capable of being assembled to operate at a desired fluid displacement selected from multiple displacements.

A still further object of the invention is to provide a fixed displacement pump having a rotor with improved area available to port fluid into or out of the pump.

These and other objects will be apparent to those skilled in the art.

SUMMARY OF THE INVENTION

A fixed displacement pump includes a housing having a cavity, an inlet, and an end cap with alignment portions therein. A cam ring pivotally associated within the cavity includes adjustment portions. The cam ring is aligned in a fixed position via a pin inserted through both a select adjustment portion and a corresponding alignment portion. The adjustment portion selected determines both rotational direction and displacement of the pump. The cam ring also includes recesses positioned adjacent the inlet to facilitate porting of fluid through the pump. A rotor mounted within the cam ring includes roller slots having groove segments. The groove segments are positioned in an arcuate arrangement about the rotor to facilitate porting of fluid through the pump. The rotor also includes undercut portions positioned between the roller slots in an arcuate arrangement on an outer edge of the rotor to facilitate porting of fluid through the pump.

DESCRIPTION OF THE PREFERRED EMBODIMENT

Figure 1:
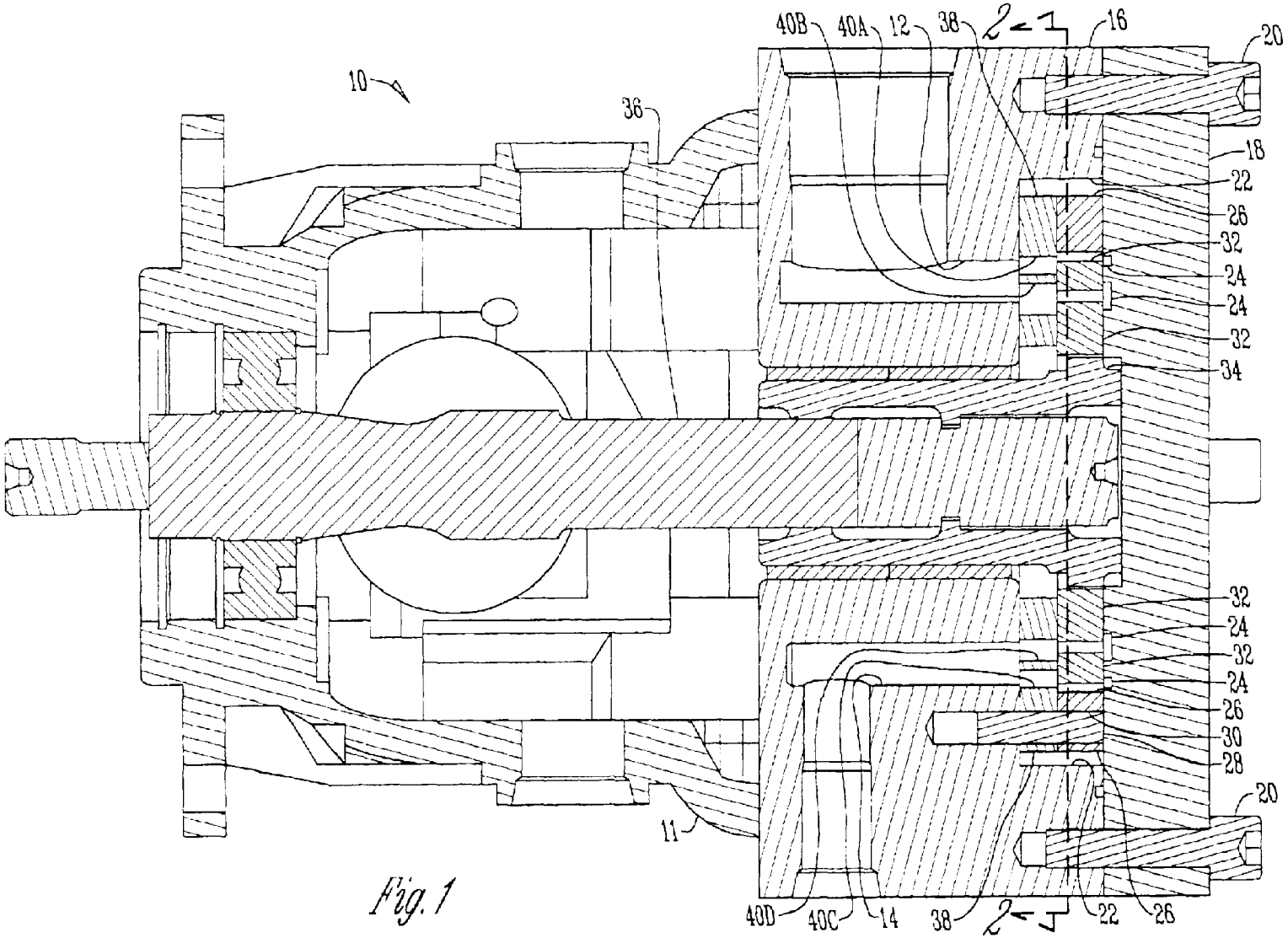
FIG. 1 is a sectional side view of the device of this invention.

With reference to FIG. 1, hydraulic pump 10 is shown as a fixed displacement roller vane pump having a housing 11 including a single inlet 12 and a single outlet 14 formed in end cap 16. A cover 18 to housing 11 is secured to the end cap 16 by fasteners 20, creating cavity 22 between the end cap 16 and the cover 18. Cover 18 has fluid passages 24 designed for equalizing the pressure of influent and effluent fluid run through the pump 10.

A cam ring 26 is located in the cavity 22 and pivotally associated with the housing 11 via pin 28 inserted through a pivot hole 30 in the cam ring 26 and into end cap 16.

A rotor 32 is rotatably mounted within the cam ring 26. A coupling element 34 attaches the rotor 32 to a shaft 36 to rotatably associate the rotor 32 to the housing 11.

A port plate 38 is located within the cavity 22, between the end cap 16 and both the cam ring 26 and the rotor 32. The port plate 38 directs the flow of fluids from the inlet 12 to the rotor 32 and from the rotor 32 to the outlet 14 through ports 40A–D formed in the port plate 38. Outer inlet port 40A is located on an outer radius of the port plate 38 and adjacent the inlet 12. Inner inlet port 40B is located on an inner radius of the port plate 38 and adjacent the inlet 12. Outer outlet port 40C is located on an outer radius of the port plate 38 and adjacent the outlet 14. Inner outlet port 40D is located on an inner radius of the port plate 38 and adjacent the outlet 14.

Figure 2:
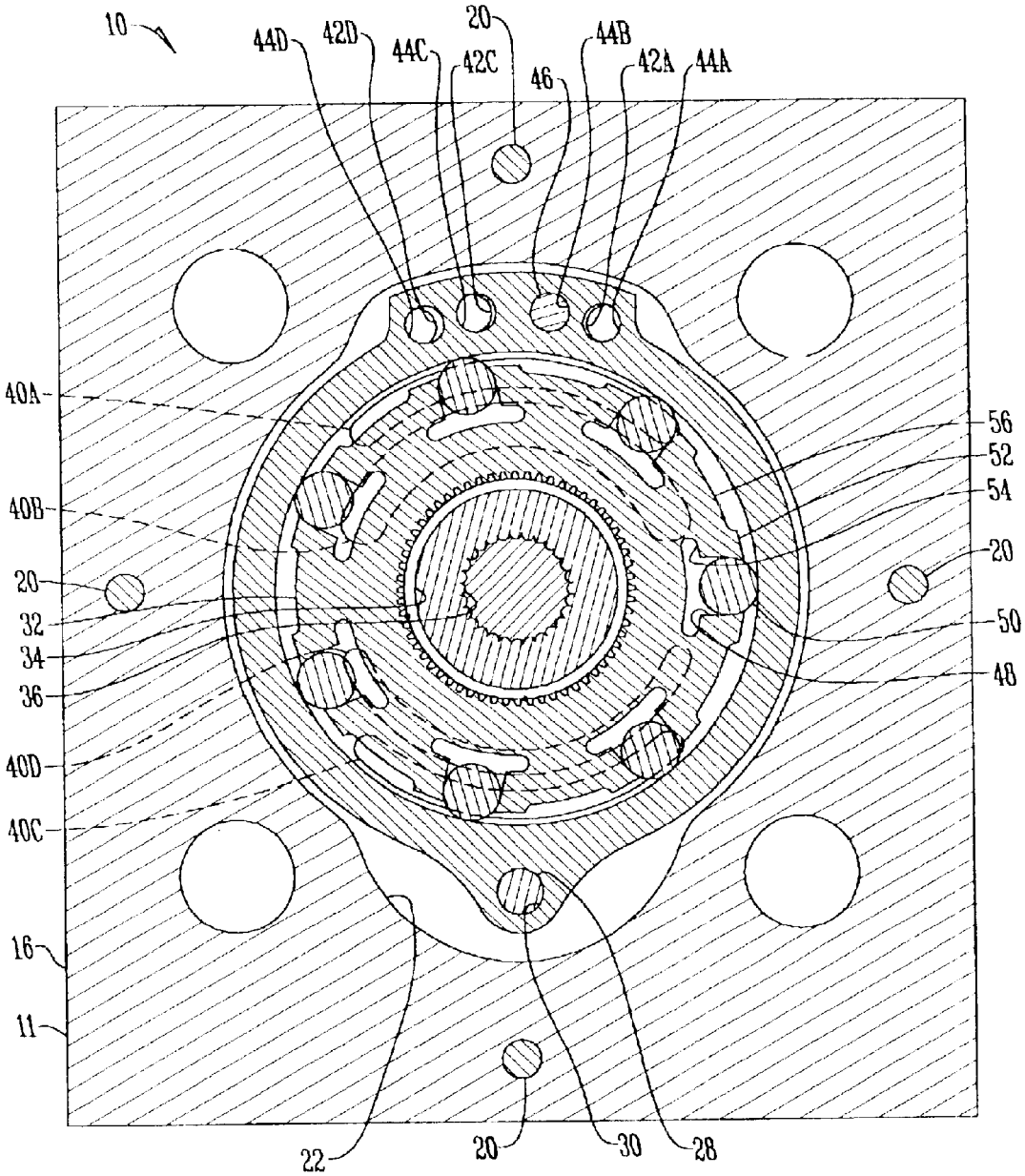
FIG. 2 is a sectional end view of the device of this invention taken along line 2—2 of FIG. 1.
Figure 5:
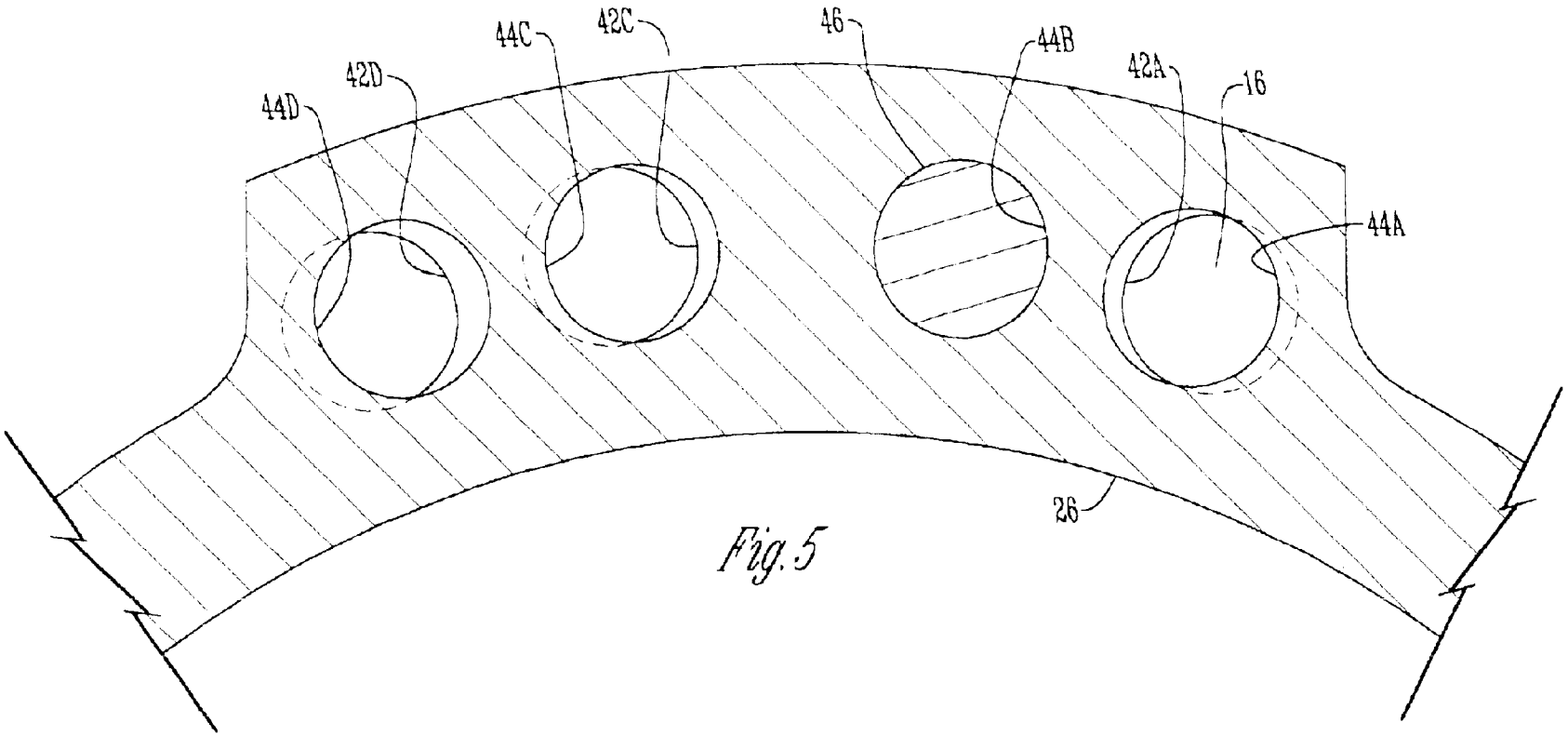
FIG. 5 is an enlarged partial sectional end view of the cam ring of the device of this invention shown in FIG. 3.

With reference to FIGS. 2 and 5, a plurality of alignment portions 42A–D (42B not shown) are formed as holes in the end cap 16 portion of housing 11. These alignment portions 42A–D allow the assembler of pump 10 to correctly align the cam ring 26 within cavity 22.

A plurality of adjustment portions 44A–D are formed as holes in the cam ring 26. The adjustment portions 44A–D and alignment portions 42A–D are slightly offset from one another so that only one adjustment portion 44A–D and one alignment portion 42A–D can be simultaneously registered. Once an adjustment portion 44A–D is selected and properly registered with the corresponding alignment portions 42A–D, a pin 46 is inserted through both the select adjustment portion 44B and the corresponding alignment portion 42B (42B not shown) to fix the cam ring 26 in a given eccentric position within the cavity 22.

The adjustment portions 44A–D are designed to provide multiple choices for fixed eccentric positions of the cam ring 26. The choice of fixed eccentric position directly impacts the performance characteristics of the pump 10 by changing the effect of the cam ring 26 on the rotor 32. The adjustment portions 44A–D are designed to provide for the selection between clockwise and counterclockwise rotation of the rotor. For example, selection of adjustment portions 44A or 44B will permit the pump 10 to operate in a clockwise direction (from the perspective of FIG. 2). Likewise, the selection of adjustment portions 44C or 44D will cause the pump 10 to operate in a counterclockwise direction.

Further, the adjustment portions 44A–D are designed to provide for the selection between a first amount of fluid displacement and a second amount of fluid displacement greater than the first amount. For example, selection of adjustment portions 44B or 44C will cause the pump 10 to operate with a lesser displacement; while the selection of adjustment portions 44A or 44D will cause the pump 10 to operate with a greater displacement.

Roller slots 48 are provided for receiving rollers 50 along the outer edge 52 of the rotor 32. Additional groove segments 54 are positioned on either side of each roller slot 48. These groove segments 54 are positioned in an arcuate arrangement about the rotor 32 which mirrors the position of the inner ports 40B and 40D. These groove segments 54 provide an expanded fluid flow area adjacent to the inner ports 40B and 40D which facilitates the porting of hydraulic fluid through the pump 10. Further, the expanded fluid flow area allows the porting of fluid to be accomplished on one side of the pump 10, eliminating the need for a second port plate on the cover 18 side of the pump 10.

Undercut portions 56 are positioned along the outer edge 52 of the rotor 32 between each roller slot 48. These undercut portions 56 are positioned in an arcuate arrangement about the rotor 32 which mirrors the position of the outer ports 40A and 40C. These undercut portions 56 provide an expanded fluid flow area adjacent to the outer ports 40A and 40C, which facilitates the porting of hydraulic fluid through the pump 10. Further, the expanded fluid flow area allows the porting of fluid to be accomplished on one side of the pump 10, eliminating the need for a second port plate on the cover 18 side of the pump 10.

Figure 3:
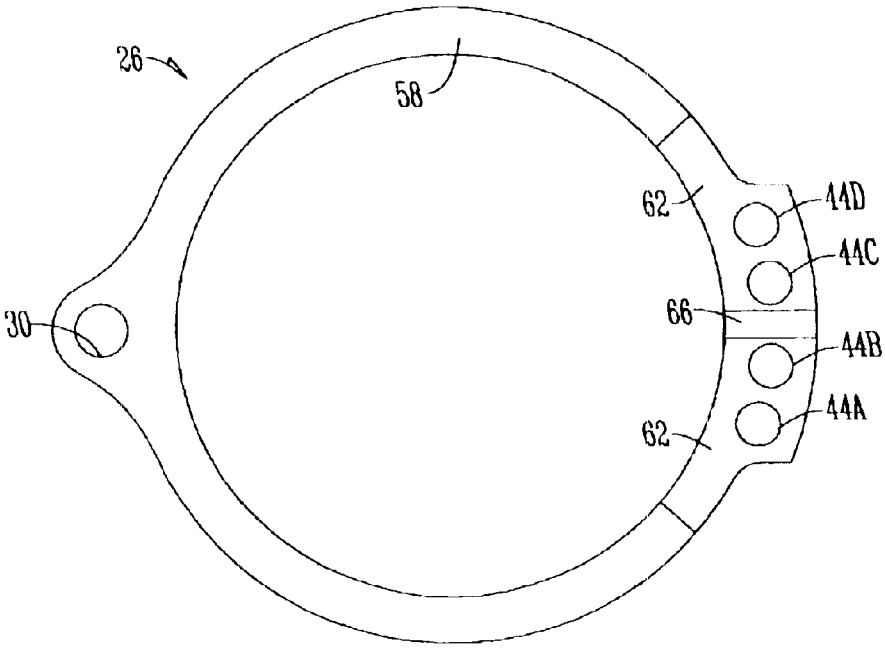
FIG. 3 is an end view of a cam ring of the device of this invention.
Figure 4:
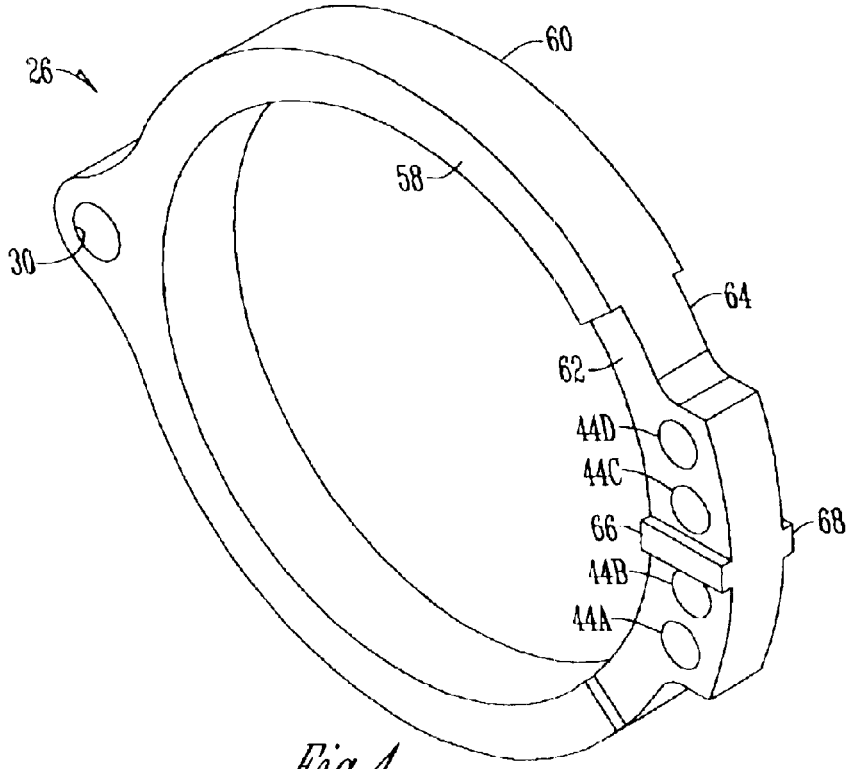
FIG. 4 is a perspective view of the cam ring of the device of this invention.

With reference to FIGS. 3 and 4, outer face 58 and inner face 60 of the cam ring 26 are shown. The outer face 58 and inner face 60 of the cam ring 26 form a uniform thickness therebetween.

Recesses 62 and 64 are formed on each face 58 and 60, and located in the same portion of the cam ring 26 as the adjustment portions 44A–D. The recesses 62 and 64 are positioned adjacent to the fluid inlet 12 of the pump 10, which facilitates the porting of hydraulic fluid through the pump by increasing the fluid flow area available adjacent to the rotor 32. This increased area allows for operation of the pump 10 at higher speeds.

Each recess 62 and 64 is divided by a ridge 66 and 68, respectively. The ridges 66 and 68 form a uniform thickness therebetween, which is the same as the thickness between the outer face 58 and inner face 60 of the cam ring 26.

It is therefore seen that the present invention provides a fixed displacement pump capable of being assembled to operate in either rotational directions and at a desired fluid displacement. The present invention further provides a fixed displacement pump having a rotor with improved area available to port fluid into or out of the pump.

It is therefore seen that this invention will accomplish at least all of its stated objectives. These and other objects will be apparent to those skilled in the art.

We claim:

1. A fixed displacement hydraulic pump, comprising:

a housing having a cavity and a plurality of alignment portions;

a cam ring positioned in the cavity and pivotally associated with the housing, the cam ring having a plurality of adjustment portions; and wherein while the pump is assembled the adjustment portions are adapted to eccentrically align the cam ring in a permanently fixed position within the cavity by a select adjustment portion registering with a corresponding alignment portion of the housing.

2. The pump of claim 1, wherein only one adjustment portion and one alignment portion can be simultaneously registered.

3. The pump of claim 1, wherein adjustment portions provide for the selection between clockwise and counterclockwise rotation of the rotor.

4. The pump of claim 1, wherein adjustment portions provide for the selection between a first amount of fluid displacement and a second amount of fluid displacement greater than the first amount.

5. The pump of claim 1, wherein the adjustment portions and alignment portions are holes, and the select adjustment portion is engaged to the corresponding alignment portion by a pin inserted through both the select adjustment portion and the corresponding alignment portion.

6. The pump of claim 5, wherein the housing includes an end cap and a cover affixed to the end cap, the cavity being formed between the end cap and cover, and wherein the alignment portions are holes formed in the end cap of the housing.

7. The pump of claim 1, wherein the pump is a roller vane pump, further comprising a rotor rotatably mounted within the cam ring, the rotor having a plurality of roller slots for receiving rollers.

8. The pump of claim 7, wherein the roller slots include groove segments positioned in an arcuate arrangement about the rotor facilitating the porting of hydraulic fluid through the pump.

9. The pump of claim 7, wherein the rotor includes undercut portions positioned in an arcuate arrangement between the roller slots on an outer edge of rotor facilitating the porting of hydraulic fluid through the pump.

10. The pump of claim 1, wherein the pump has a fluid inlet and outlet, the cam ring has an outer and inner face, and a recess on each face of the cam ring positioned adjacent to the fluid inlet of the pump.

11. The pump of claim 10, wherein the adjustment portions and the recesses are located in the same portion of the cam ring.

12. A fixed displacement hydraulic pump, comprising:

a housing having a cavity and a plurality of alignment portions;

a cam ring positioned in the cavity and pivotally associated with the housing, the cam ring having a plurality of adjustment portions;

wherein the adjustment portions are adapted to eccentrically align the cam ring in a fixed position within the cavity by a select adjustment portion registering with a corresponding alignment portion of the housing; and wherein the adjustment portions and alignment portions are holes, and the select adjustment portion is engaged to the corresponding alignment portion by a pin inserted through both the select adjustment portion and the corresponding alignment portion.

13. The pump of claim 12, wherein the housing includes an end cap and a cover affixed to the end cap, the cavity being formed between the end cap and cover, and wherein the alignment portions are holes formed in the end cap of the housing.

14. A fixed displacement roller vane hydraulic pump, comprising:

a housing having a cavity therein;

a cam ring positioned in the cavity;

a rotor rotatably mounted within the cam ring, the rotor having a plurality of roller slots for receiving rollers, wherein the roller slots include groove segments positioned in an arcuate arrangement about the rotor facilitating the porting of hydraulic fluid through the pump;

wherein the rotor includes undercut portions positioned in an arcuate arrangement between the roller slots on an outer edge of rotor facilitating the porting of hydraulic fluid through the pump; and wherein the housing includes a plurality of alignment portions, the cam ring is pivotly associated with the housing and has a purality of adjustment portions, the adjustment portions are adapted to eccentrically align the cam ring in a fixed position within the cavity by a select adjustment portion registering with a corresponding alignment portion of the housing, and wherein only one adjustment portion and one alignment portion can be simultaneously registered; and wherein the housing includes and end cap and a cover affixed to the end cap, the cavity being formed between the end cap and cover wherein the alignment portions are holes formed in the end cap of the housing, wherein the adjustment portions are holes formed in the cain ring, and the select adjustment portion is engaged to the corresponding alignment by a pin inserted through both the select adjustment portion and the corresponding alignment portion.

15. The pump of claim 14, wherein adjustment portions provide for the selection between clockwise and counterclockwise rotation of the rotor.

16. The pump of claim 14, wherein adjustment portions provide for the selection between a first amount of fluid displacement and a second amount of fluid displacement greater than the first amount.

17. The pump of claim 14, wherein the pump has a fluid inlet and outlet, the cam ring has an outer and inner face, and a recess on each face of the cam ring positioned adjacent to the fluid inlet of the pump.

* * * * *